US007571811B2

(12) United States Patent
Mulaw

(10) Patent No.: US 7,571,811 B2
(45) Date of Patent: Aug. 11, 2009

(54) MEDICATION ORGANIZER

(76) Inventor: Azanaw Mulaw, 1901 Thistlewood Dr., Fort Washington, MD (US) 20744

( * ) Notice: Subject to any disclaimer, the term of this patent is extended or adjusted under 35 U.S.C. 154(b) by 69 days.

(21) Appl. No.: 12/068,214

(22) Filed: Feb. 4, 2008

(65) Prior Publication Data

US 2008/0230433 A1 Sep. 25, 2008

Related U.S. Application Data

(60) Provisional application No. 60/918,916, filed on Mar. 20, 2007.

(51) Int. Cl.
*B65D 83/04* (2006.01)

(52) U.S. Cl. ..... 206/535; 312/305; 312/125; 312/330.1; 206/538

(58) Field of Classification Search ..... 206/535, 206/528, 529, 534, 538, 828, 1.5; 312/330.1, 312/305, 125, 309, 249.4, 348.3, 35, 97, 312/209; 220/345.1, 345.2
See application file for complete search history.

(56) References Cited

U.S. PATENT DOCUMENTS

| | | | | | |
|---|---|---|---|---|---|
| 444,216 | A | | 1/1891 | Bodenhamer | |
| 1,908,797 | A | | 5/1933 | Svalland | |
| 2,827,354 | A | * | 3/1958 | Wassell et al. | 312/305 |
| 2,882,114 | A | | 4/1959 | Sease et al. | |
| 3,698,779 | A | * | 10/1972 | Holmes et al. | 312/126 |
| 4,148,273 | A | | 4/1979 | Hollingsworth et al. | |
| 4,245,742 | A | * | 1/1981 | Rossmo | 206/534 |
| 4,334,617 | A | * | 6/1982 | Rossmo | 206/534 |
| 4,632,474 | A | * | 12/1986 | Ingersoll | 312/305 |
| 4,697,856 | A | | 10/1987 | Abraham | |
| 4,753,340 | A | | 6/1988 | Blakeman et al. | |
| 4,796,960 | A | * | 1/1989 | Candelas | 312/305 |
| 4,815,767 | A | | 3/1989 | Lambert | |
| 5,431,450 | A | | 7/1995 | Coleman | |
| 5,469,992 | A | * | 11/1995 | Jenkins | 222/362 |
| D365,718 | S | | 1/1996 | Morin | |
| 5,558,417 | A | | 9/1996 | Termotto | |
| 5,713,648 | A | | 2/1998 | Geib et al. | |
| 5,752,235 | A | | 5/1998 | Kehr et al. | |
| D398,180 | S | | 9/1998 | Winter et al. | |
| 5,833,330 | A | | 11/1998 | Kos | |
| 5,838,224 | A | | 11/1998 | Andrews | |
| 5,850,937 | A | | 12/1998 | Rauche | |
| 5,921,394 | A | * | 7/1999 | Shroff | 206/534 |

(Continued)

FOREIGN PATENT DOCUMENTS

DE 35 40 736 A1 5/1987

*Primary Examiner*—Jacob K Ackun, Jr.
*Assistant Examiner*—Robert Poon
(74) *Attorney, Agent, or Firm*—Richard C. Litman

(57) ABSTRACT

The medication organizer is a portable, wall-mountable, carousel-style cabinet for dispensing medication and, more particularly, a medication dispenser in which a plurality of different medication dosages can be contained in separate bins with the dispenser being clearly marked to indicate which dosages and times a user is to take a specific medication. The device includes a portable cabinet having a rotatable carousel for capsule containers, drug bottles, etc, and a drawer having at least one removable drawer tray that includes a plurality of bins arranged longitudinally side-by-side. The bins are provided for receiving individual medication dosages, e.g., groups of individual pills, capsules, or the like. The carousel has an arcuate sliding door for securing the contents therein.

9 Claims, 6 Drawing Sheets

U.S. PATENT DOCUMENTS

| | | | | |
|---|---|---|---|---|
| 5,984,685 | A | | 11/1999 | Portnoy |
| 6,073,794 | A | * | 6/2000 | Bidot ..... 220/529 |
| 6,086,171 | A | * | 7/2000 | Ashley et al. ..... 312/97.1 |
| 6,145,697 | A | | 11/2000 | Gudish |
| 6,259,654 | B1 | | 7/2001 | de la Huerga |
| 6,324,123 | B1 | | 11/2001 | Durso |
| 6,401,991 | B1 | | 6/2002 | Eannone |
| 6,464,506 | B1 | | 10/2002 | Welles |
| 6,574,165 | B2 | | 6/2003 | Sharma et al. |
| 6,644,496 | B1 | | 11/2003 | Ambrosio |
| 6,769,545 | B1 | | 8/2004 | Mallams |
| 6,860,390 | B2 | | 3/2005 | Bowman |

* cited by examiner

MEDICATION ORGANIZER

CROSS-REFERENCE TO RELATED APPLICATION

This application claims the benefit of U.S. Provisional Patent Application Ser. No. 60/918,916, filed Mar. 20, 2007.

BACKGROUND OF THE INVENTION

1. Field of the Invention

The present invention relates to cabinets, organizers and storage cases, and particularly to a medication organizer for storing medications.

2. Description of the Related Art

The success of any medical treatment outcome is measured not only by the quality of care we all receive from our respective healthcare professionals or any other modern medical wonder available to our disposal but also the responsibility we share with those care providers.

According to a study published in the Oct. 18, 2004 issue of the Journal of the American Medical Association, more than 80% of US residents reported using a prescription medication, over-the-counter (otc) drug or dietary supplement. In another research, in 2002 alone, Americans filled 3,340,000,000 outpatient prescriptions. That is about 12 prescriptions for every man, women, and child in America. U.S. drug sales in this same year reached $219 billion. Prescription drug sales rose by an annual average of 11 percent between 2000 and 2005. Americans now fill more than three billion prescriptions a year.

When appropriately prescribed, administered and monitored, medications are a cost effective way to help maintain health, recover from illness or control symptoms of chronic diseases. Medication users can live stronger, longer and lead a normal and happier life by carefully following their doctor's, pharmacists and other healthcare professionals directly involved in their care instructions regarding medications as well as by sharing responsibilities with their care providers. The most important aspect of this patient responsibility lies on compliance. Patients need to organize their medications in such a way it is easy for them to access when needed on a given time period without interrupting the medication cycle. The therapeutic effect of medications can only be assessed and achieved if medications are taken according to dosage guidelines. At the same time, organizing personal medications can facilitate easy access, minimize confusion, reduce medical errors, increase compliance, and provides safety and protection.

People age sixty-five and older make up twelve percent of the U.S. population, but account for thirty-four percent of all prescription medication use and thirty percent of all over-the-counter medication use. Because older adults often take numerous medications prescribed by multiple health care providers, their risk of having an adverse reaction is greater than that of younger adults. Some of the barriers to proper medication use are, skipping doses, the challenge for correctly adhering to medication regimens, a mix-up or not having organized all medications for easy access and a full visual control of prescribed medications to assess the need for future refills as well as to remove unwanted/expired or discontinued medications as necessary.

According to researchers, about sixty percent of older adults take their prescriptions improperly, and approximately 140,000 die each year as a result. Research shows that older adults who fail to take prescribed medications were seventy-six percent more likely to experience a significant decline in their overall health than those who took all medications as prescribed.

Compliance, or adherence, as it relates to health care is the extent to which a person's behavior coincides with medical or health advice. Medication compliance is critical for all aspects of patient population be it for those patients under physicians' direct supervision or those who self treat, specifically in successful treatment, disease prevention, and health promotion. Compliance depends on the patient's and the corresponding healthcare provider's commitment to the same objectives. It is unfortunate that numerous studies and physician, pharmacists and other healthcare professional accounts reveal difficulties in achieving compliance with prescribed medication regimen therapy. Medication compliance in all patients ranges from 11% to 93%. At least one third of all patients fail to complete relatively short to long-term treatment regimens. Poor compliance places patients at risk for problems such as continued disease, complicates the healthcare professionals-patient relationship, and prevents accurate assessment of the quality of care provided.

According to the Centers for Disease Control and Prevention (CDC) in a report released Jan. 12, 2006, keeping medications out of the easy grasp of children four and younger in the home is a significant health issue in the United States because they are more likely to be hospitalized for unintentionally swallowing medications than other causes of unintentional injury.

From 2001-2003, an estimated 53,500 children four years and younger were treated in hospital emergency departments each year after swallowing medications not intended for them or given in error. Almost three-fourths of these children were one to two years old and seventy-five percent of the incidents occurred in the home. The report also indicated that children four and younger who are treated for medication exposure in the emergency room are nearly four times more likely to be hospitalized or transferred to specialized care than for other unintentional injuries.

Thus, a medication organizer solving the aforementioned problems is desired.

SUMMARY OF THE INVENTION

The medication organizer is a portable, wall mountable carousel-style cabinet for dispensing medication and, more particularly, a medication dispenser in which a plurality of different medication dosages can be contained in separate bins with the dispenser being clearly marked to indicate which dosages and times a user is to take a specific medication. The device includes a portable cabinet having a rotatable carousel for capsule containers, drug bottles, etc., and at least one drawer having at least one removable drawer tray that includes a plurality of bins arranged longitudinally side-by-side. The drawers can be stackable and include a locking device to hold them in place. The bins are provided for receiving individual medication dosages, e.g., groups of individual pills, capsules, or the like. The carousel has an arcuate sliding door for securing the contents therein.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a portable, wall mountable carousel styled cabinet for dispensing medication and more particularly, a medication dispenser in which a plurality of different medication dosages can be contained in separate bins with the dispenser being clearly marked to indicate which dosages and times a user is to take a specific medication. The device includes a portable cabinet having a rotatable carousel for capsule containers, drug bottles, etc, and a drawer having at least one removable drawer tray that includes a plurality of bins arranged longitudinally side by side. The bins are provided for receiving individual medication dosages, e.g., groups of individual pills, capsules, or the like. The carousel has an arcuate sliding door capable of securing the contents therein.

Figure 1:
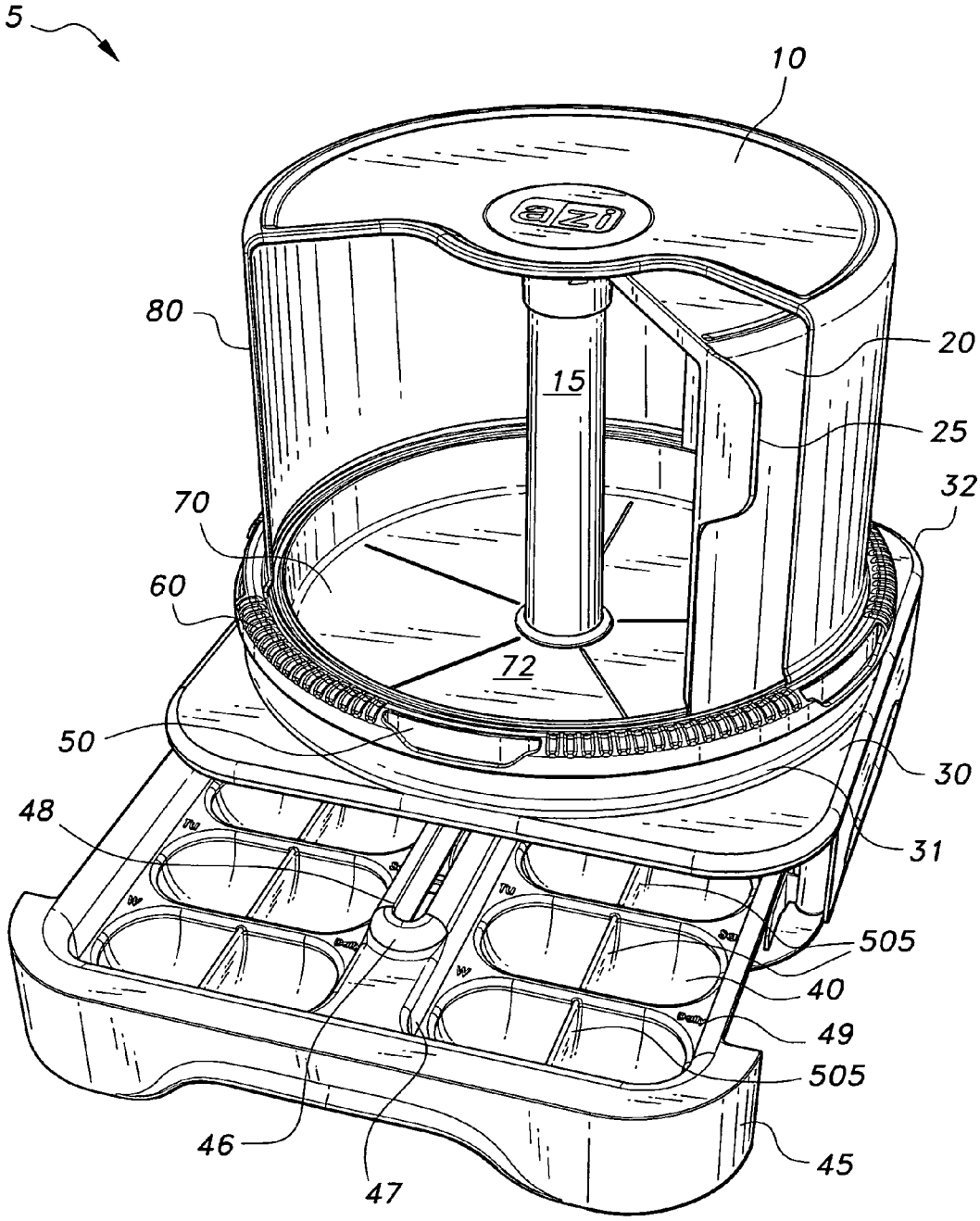
FIG. 1 is an environmental, perspective view of a medication organizer according to the present invention.
Figure 3:
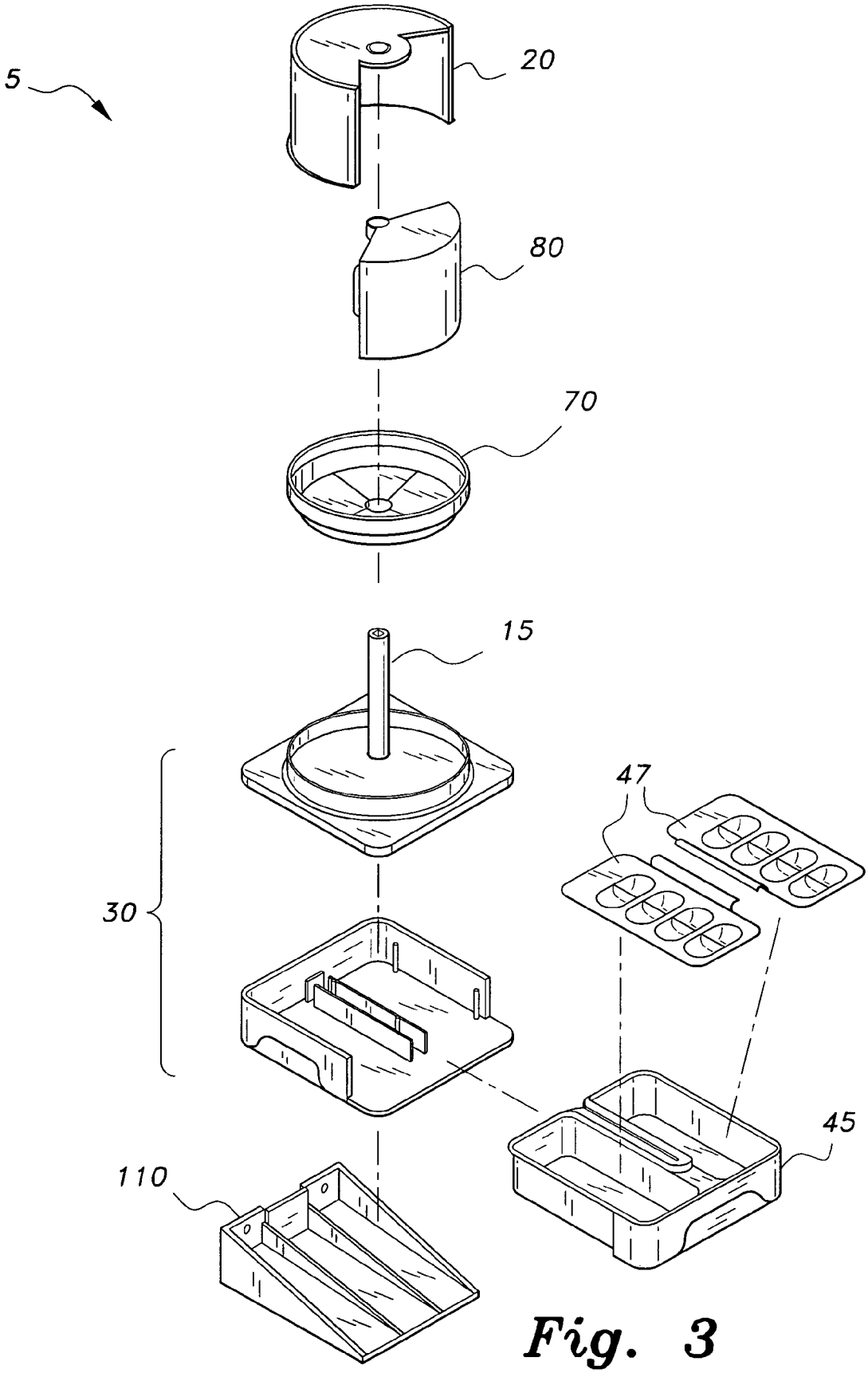
FIG. 3 is an exploded perspective view of the medication organizer according to the present invention.

As shown in FIGS. 1 and 3, the cabinet 5 has a circular, carousel 70, rotatably attached through a central tubular support column 15 of rectangular base 30, the base 30 having rounded corners 32. The carousel 70 is preferably divided into a plurality of pie-shaped spaces 72. Disposed at intervals along the outer circumference of the carousel 70 are tabs 50 which are provided to hold identifying labels for each of the pie shaped spaces 72 to further secure and/or facilitate a fast and easy identification of stored organizer content. The base 30 has an opening capable of receiving a drawer 45. Also, disposed at intervals around the outer circumference of the carousel 70 are a plurality of finger detail ridges 60, which are provided as finger grips to assist rotation of the carousel 70 by a user. The drawer 45 can accept at least one removable tray 47 that can be lined up inside the drawer 45 via a longitudinally extending tray alignment boss 46.

Figure 4:
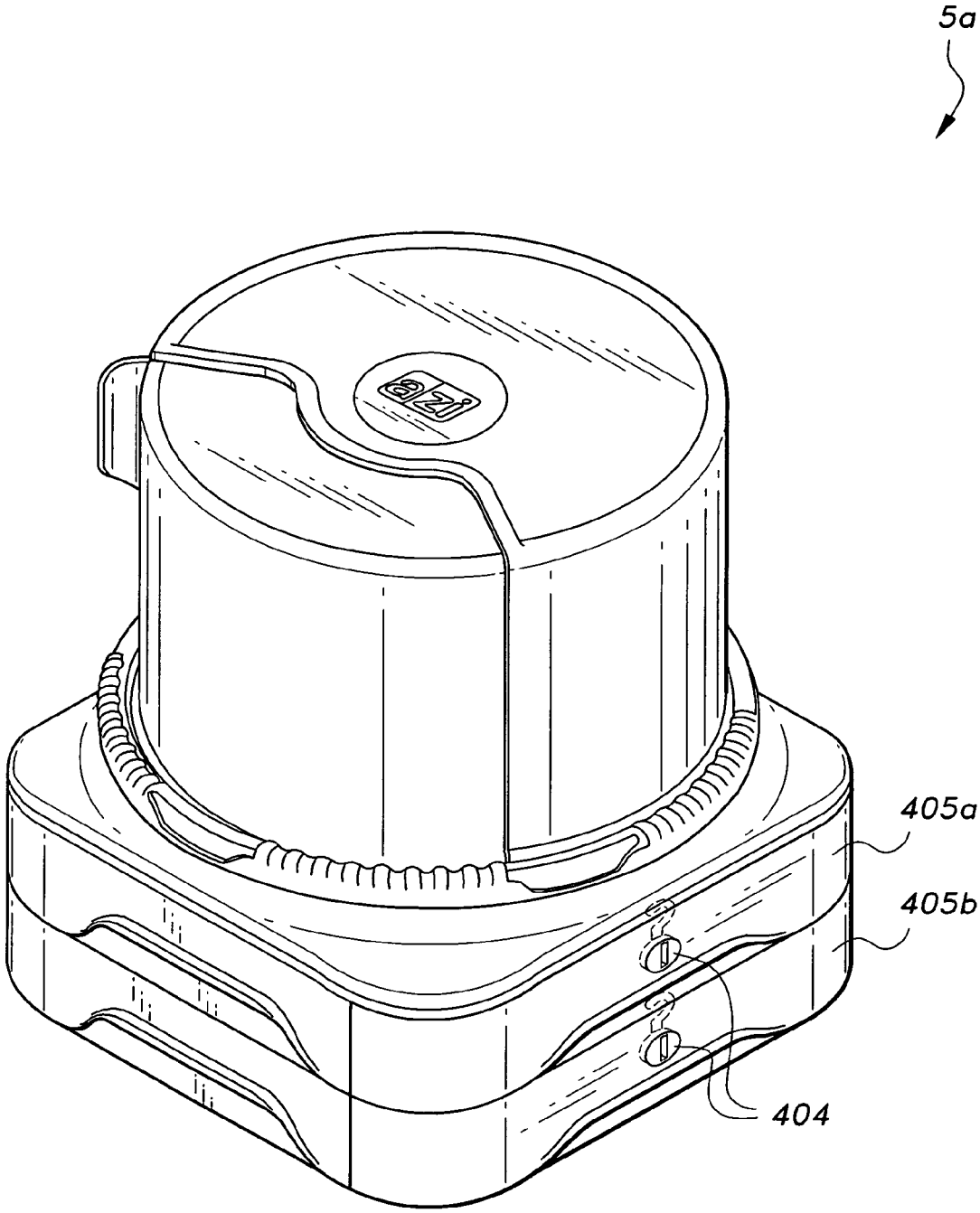
FIG. 4 is a perspective view of an alternative embodiment of a medication organizer according to the present invention.
Figure 6:
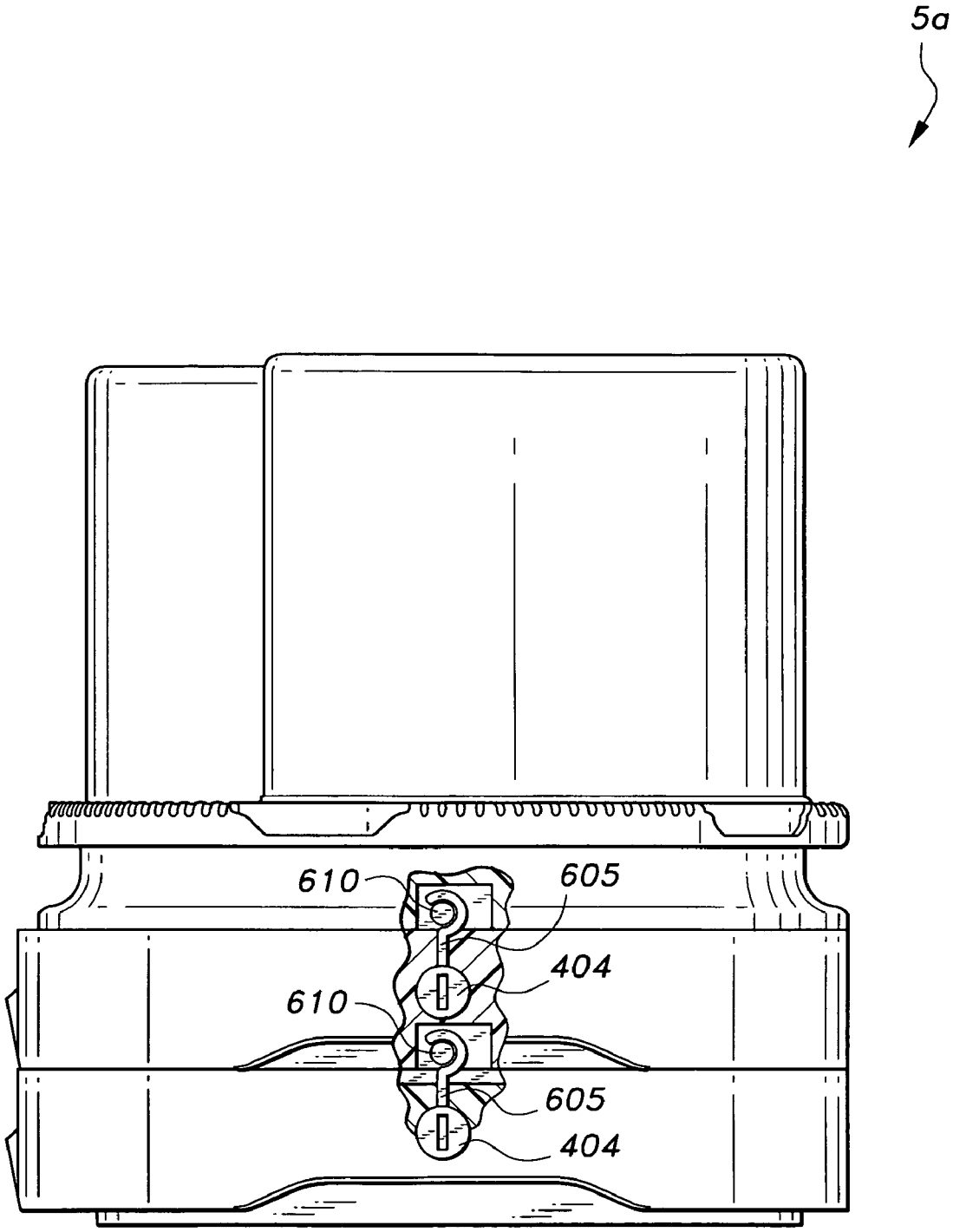
FIG. 6 is a side view of the medication organizer of FIG. 4, broken away and partially in section to show details thereof.

In addition, the drawer may have a centrally disposed smooth area branding space 90 for attachment of a branding decal or the like. As shown in FIG. 4, alternative embodiment 5*a* may include a base drawer 405*a* that has a locking device 404. Additional drawers such as drawer 405*b* may be stacked underneath the base drawer 405*a*. Each drawer may include locking device 404 for a secure, stackable attachment. As shown most clearly in FIG. 6, locking device 404 is comprised of a pivotally attached hook 605 that can engage a locking stud 610, the locking stud 610 being fixedly attached to a portion of organizer 5*a* that is immediately above the drawer to be locked.

Figure 5:
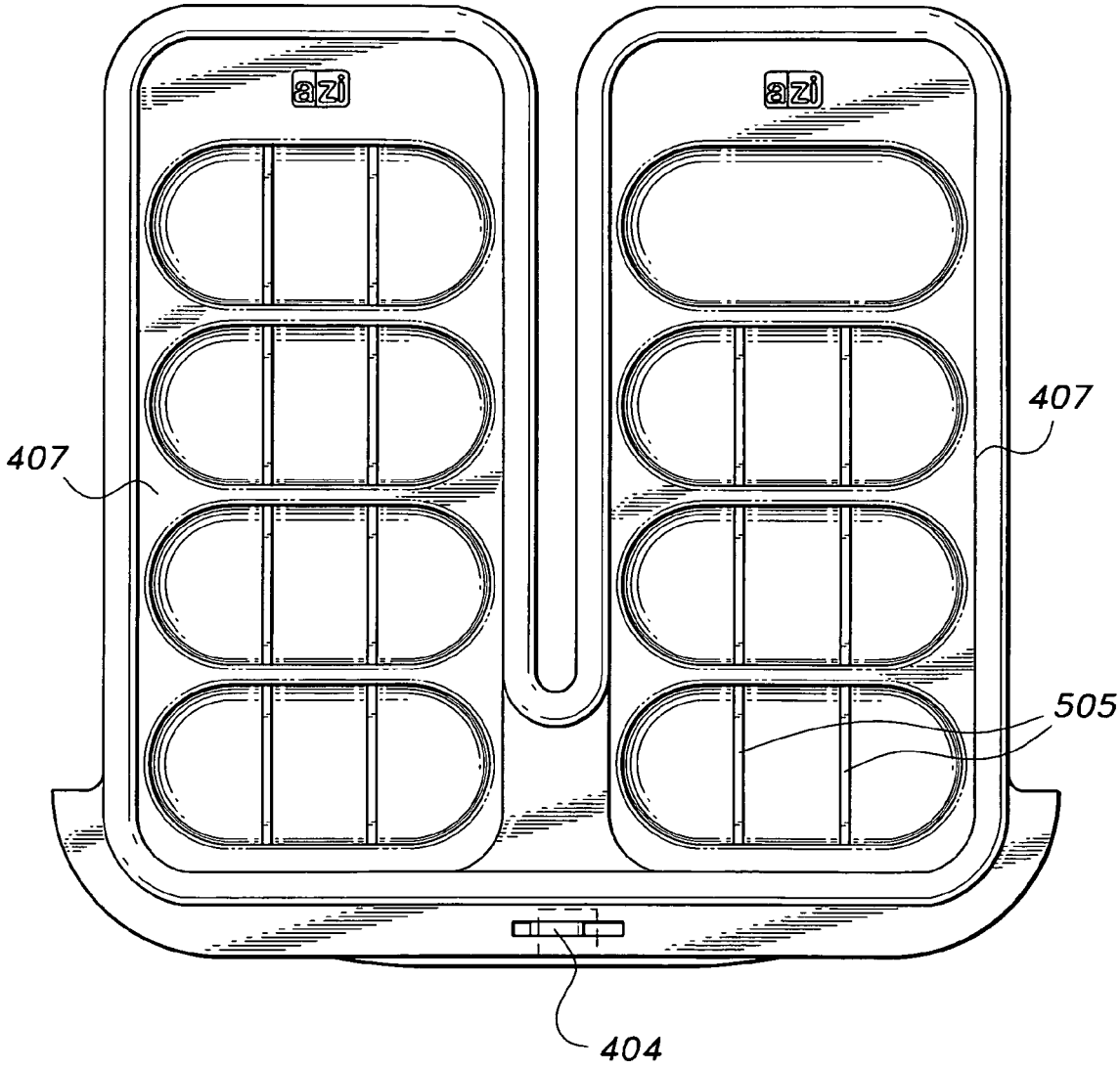
FIG. 5 is a top view of an alternative tray for a medication organizer according to the present invention.

The removable tray 47 has a plurality of bins 40 arranged longitudinally side-by-side. The bins 40 function as pill organizers, and as shown in FIGS. 1 and 5 may, but does not have to include partitions 505. For example, the bin 40 may have no partition for a once daily organizer, a single partition for a twice daily organizer, two partitions for a 3× daily organizer, and the like. Tray 47 may have indicia 49 decaled on, printed, or embossed thereon, or extruded therefrom, in order to provide a user with dosage instructions for the medication stored in the bins 40. Proper alignment of the tray 47 and drawer 45 is facilitated by aligning tray arcuate attachment member 48 with the tray alignment boss 46 as the tray is placed in the drawer 45.

The central tubular column 15 is provided as an axle for rotation of the carousel 70, to support cylindrical cover 80 having a cylindrical sectioned aperture, and also to support complementarily sectioned arcuate sliding cover door 20. The base 30 has a cylindrical guide wall 31, which facilitates alignment of the cover 80 atop the base 30. The cover 80 has a substantially planar, circular sectioned top surface 10 capable of providing additional storage of prescription and non-prescription items. The cover door 20 includes an ergonomically designed handle 25 to facilitate ease of opening and closing the door 20. The cover 80, in combination with the complementary semi-cylindrical sliding door 20, is capable of concealing and protecting bottled medications and supplements. All components of the cabinet 5 can be made of any suitable lightweight material, such as metal, aluminum, thermoplastics, or the like.

Figure 2:
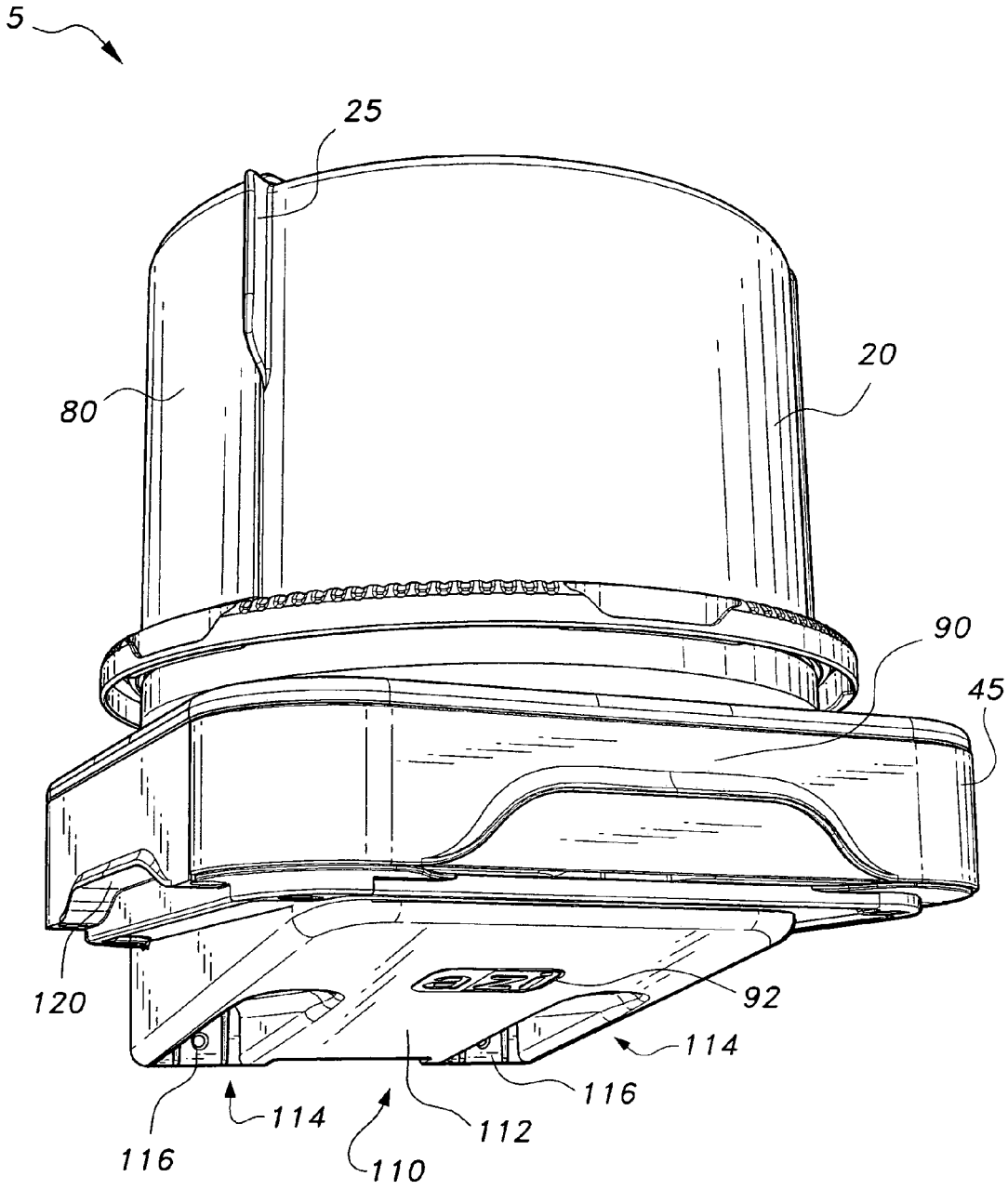
FIG. 2 is a perspective view of the medication organizer according to the present invention, showing a wall-attachment bracket with carousel door and pill drawer in closed positions.

Turning now to FIG. 2, the cabinet 5 is shown to have ergonomic handles 120 disposed along lower lateral sides of the rectangular base 30. A wedge-shaped wall-attachment bracket 110 extends from the bottom of base 30. The bottom 112 of the attachment bracket 110 has a branding space 92 provided to receive brand name, manufacturing name, or the like, indicia. Also, the bracket bottom 112 has two laterally opposed access cavities 114, which provide access to wall-fastening bores 116.

While a cabinet 5 having single carousel 70 has been described in detail, cabinet 5 may have more than one carousel 70. Also, cabinet 5 may be provided with additional compartments as necessary to accommodate other health related items. Cabinet 5 can be made with an integral alarm clock or any other alarm triggering device, light source, and additional safety device. The medication organizer can be used on a countertop, inside a kitchen cabinet, or can be mounted on a wall. In addition, the cabinet 5 can be used in various places in and around a dwelling, office building, hospital, clinic, or the like.

Drawer 45 can be automated for opening and closing thereof. Moreover, carousel 70 can be automated for rotation thereof. The pill organizer bins 40 can be labeled with daily, weekly, bi-monthly, or as a once a month organizer having different time intervals than shown in FIG. 1. The carousel 70 can have a different shape other than circular, i.e., the carousel 70 may have a polygonal shape, such as square, rectangular, or the like. The carousel 70 can also be made in such a way that it can slide back and forth towards the user, in addition to being in a fixed position. The device 5 can be made without a cover 80, or with only a partial cover. Moreover, the organizer can have multiple drawers opening in multiple directions from the base 30. The organizer may have drawers 45 without the pill-organizing tray 47. The tray 47 may be designed to provide pill storage in an alternative manner different from the bins 40 shown, as well as to store first-aid items and the like whenever appropriate.

It is to be understood that the present invention is not limited to the embodiment described above, but encompasses any and all embodiments within the scope of the following claims.

I claim:

1. A medication organizer, comprising:

a portable cabinet having a base and a central tubular support column extending from the base, the base having an opening for at least one drawer;

a rotatable carousel disposed on the central tubular support column and resting atop the base;

a drawer disposed in the base, the drawer having at least one removable drawer tray, the tray having a plurality of bins arranged longitudinally side-by-side;

a removable, cylindrical cover removably disposed atop the base, the cover being supported by the support column, the cylindrical cover having a cylindrical, sectioned aperture for access to the carousel; and a complementary sectioned, sliding, arcuate cover door having a hub supported by the support column, the door being rotatable to open and close the aperture.

2. The medication organizer according to claim 1, further comprising tabs disposed at intervals along an outer circumference of the carousel, the tabs identifying corresponding internal spaces of the carousel.

3. The medication organizer according to claim 1, further comprising corrugated finger grips disposed at intervals along an outer circumference of the carousel, the finger grips assisting rotation of the carousel by a user.

4. The medication organizer according to claim 1, further comprising ergonomic handles disposed along lower lateral sides of the cabinet base.

5. The medication organizer according to claim 1, further comprising a wedge-shaped wall-attachment bracket extending from the bottom of the base, the bracket having a pair of laterally opposed access cavities and a pair of wall fastening bores accessible from the laterally opposing access cavities.

6. The medication organizer according to claim 1, further comprising a medication dosage frequency organizing partition disposed in the bin.

7. The medication organizer according to claim 1, further comprising medication dosage frequency indicia disposed in the bin.

8. The medication organizer according to claim 1, further comprising:

a lock stud disposed in the base; and a rotatable lock assembly disposed in the drawer, the rotatable lock assembly engaging the lock stud to secure the drawer in a closed position to the base.

9. The medication organizer according to claim 8, further comprising a plurality of drawers, each of the drawers being stackable underneath the base drawer, each of the drawers having a lock mechanism and a lock stud, each of the drawers being secured to an adjacent upper drawer.

* * * * *